US007201649B2

(12) United States Patent
Abe

(10) Patent No.: US 7,201,649 B2
(45) Date of Patent: Apr. 10, 2007

(54) COIN DISPENSING DEVICE

(75) Inventor: Hiroshi Abe, Iwatsuki (JP)

(73) Assignee: Asahi Seiko Kabushiki Kaisha (JP)

( * ) Notice: Subject to any disclaimer, the term of this patent is extended or adjusted under 35 U.S.C. 154(b) by 113 days.

(21) Appl. No.: 10/960,374

(22) Filed: Oct. 7, 2004

(65) Prior Publication Data

US 2005/0101242 A1 May 12, 2005

(30) Foreign Application Priority Data

Nov. 11, 2003 (JP) ..... 2003-381829

(51) Int. Cl.
*G07D 1/00* (2006.01)

(52) U.S. Cl. ..... 453/29

(58) Field of Classification Search ..... 453/29, 453/18, 30, 32, 33, 34, 35, 57; 193/35 A
See application file for complete search history.

(56) References Cited

U.S. PATENT DOCUMENTS 4,592,377 A * 6/1986 Paulsen et al. ..... 453/33
4,943,258 A 7/1990 Abe
5,462,480 A 10/1995 Suzukawa
6,039,166 A * 3/2000 Abe et al. ..... 194/317
6,095,916 A * 8/2000 Tamaki ..... 453/57
6,368,204 B1 * 4/2002 Tokoyoda ..... 453/57
6,554,694 B2 * 4/2003 Umeda et al. ..... 453/56

FOREIGN PATENT DOCUMENTS

JP 4-45090 10/1992
JP 2514877 4/1996

* cited by examiner

*Primary Examiner*—Patrick Mackey
*Assistant Examiner*—Mark J. Beauchaine
(74) *Attorney, Agent, or Firm*—McGlew & Tuttle, PC

(57) ABSTRACT

A coin dispensing device is provided that prevents a returning of a first coin to prevent a clink noise. The coin dispensing device has a rotating disk that dispenses coins to a guiding unit one by one. The dispensed coins are guided upwards by the guiding unit in a line. A coin return preventing unit prevents the first coin going backward which is located adjacent to the rotating disk. The first coin dispensed by the rotating disk is prevented from moving backwards.

9 Claims, 7 Drawing Sheets

COIN DISPENSING DEVICE

CROSS REFERENCE TO RELATED APPLICATIONS

This application claims the benefit of priority under 35 U.S.C. § 119 of Japan Application No. 2003-381829 filed Nov. 11, 2003, the entire contents of which are incorporated herein by reference.

FIELD OF THE INVENTION

This present invention is related to a coin dispensing device in which a reverse movement of aligned coins is prevented. More particularly, the present invention is related to a backwards motion prevention unit for preventing coins which have been dispensed by the rotating disk and fall down, from running into the rotating disk and making noise such as a clunk. Furthermore, the present invention relates to a coin dispensing device where the returning movement of the dispensed coins which are dispensed by the rotating disk is held at a position so as not to make noise. In this specification, "coin" includes coins, tokens, discs, etc.

BACKGROUND OF THE INVENTION

A first prior art reference (Japanese Patent number 2514877—FIGS. 1–3, Pages 2–5) is known wherein the coins are dispensed to an escalator (a guiding unit) slantwise by the rotating arms one by one. The coins are also guided perpendicularly, and they are dispensed from the top of the escalator. In this prior art, tapered rollers are located immediately downstream of the rotating disk, because the coins are guided smoothly from the slanting section to the perpendicular section. As explained in the detailed explanation, coins are piled in a coin storing unit 10 in a predetermined quantity and in dominations. The coin storing unit 10 is attached to a charge dispensing apparatus.

A second prior art reference (Japanese Examed Utility Model number 4-45090—FIGS. 1–4, Pages 1–2) is known wherein a holding unit which includes a ball and a slanting surface is attached to a perpendicular guiding unit.

In the device of Japanese Patent number 2514877, the diameter section of the dispensed coin (a first coin) which was dispensed by the rotating disk can not pass between the first tapered roller and another tapered roller. Then the first coin is moved by the next dispensed coin, as a result, the coin can pass between the first tapered roller and another tapered roller. Therefore the first coin slides down by gravity, because the first coin is located at the slanting section and the next dispensed coin is dispensed intermittently. The coin that slid down runs to the next coin or the rotating disk. Therefore it makes a "clink" noise. In an operating machine where this device is situated, a user may be disturbed by the noise.

The problem is explained referring to FIGS. 6 and 7 (Prior Art) in detail. In FIG. 6, the coin dispensing unit 10 ("hopper") includes frame 12 and bowl 16 which is cylindrical and is fixed at the frame 12 and stores coins 14. The unit 10 also has a first rotating disk 18 and a second rotating disk 20 (see FIG. 7) which are located at the bottom section of the bowl 16 and dispense coins 14 and guiding unit 22 for the coins.

As shown in FIG. 7, the fallen coins go into through holes 24 of rotating disk 18 and are supported on base 26 and are moved by a pusher (not shown) which is located under the surface of the rotating disk 18. The coins are guided to the round direction of rotating disk 18 by guides 28 which protrude into the coin's moving course.

Second rotating disk 20 includes five projections 30 in the same interval and is star like in shape and rotates synchronously in the opposite direction to first rotating disk 18. The second rotating disk 20 has a function where the coins which are dispensed by first rotating disk 18 one by one are received and the received coins are moved along to the arc guiding surface 32. Also the structure and the function of first rotating disk 18 and second rotating disk 20 are the same as the structure and function disclosed in Japanese Patent number 2514877.

Gate unit 34 is located at the exit position to the second rotating disk 20. Gate unit 34 includes roller 40 which is tapered downwards and rotatable on a shaft 38. Shaft 38 is inserted into guiding groove 36 which extends at a right angle to the moving direction of the coins and is slidable and is urged to reduce the width of coin passageway 46 by spring 44 which is hooked between it self and fixed pin 42. Shaft 38 usually is stopped by the end of guiding groove 36 and has a distance to guiding surface 32 which is smaller than the diameter of the coin.

When the coin passes, the roller 40 is moved along guiding groove 36 by the coin. Afterwards the diameter section of the coin passes between guiding surface 32 and roller 40, roller 40 is moved towards guiding surface 32, then roller 40 is stopped at the above-mentioned position. Therefore the coin passes at gate unit 34, afterwards they slide down by gravity. The coin cannot return to the side of second rotating disk 20, because the distance between roller 40 and guiding surface 32 is smaller than the diameter of the coin.

However, roller 40 is located away from the second rotating disk 20 to prevent hitting the second rotating disk 20. Therefore, coin 14 is moved out by the end of projection 30, and the diameter section of the coin can not pass between roller 40 and guiding surface 32 as shown in FIG. 7. In other words, the first coin 14 which is dispensed by second rotating disk 20 cannot pass gate unit 34.

Therefore, the first coin 14 is moved by the second coin which is moved intermittently by projection 30, and first coin 14 passes through gate unit 34. Therefore, the first coin 14 which can not pass the gate unit 34 slides down by the slant of the base 26, and runs into the next coin 14. If there is not a next coin 14, the previous coin 14 runs into the next projection 30, thereby causing a "clink" by the collision.

When there isn't a gate unit 34, the moved coin 14 which was moved by the projection slides down, and runs into next coin 14 or projection 30. Therefore the "clink" occurs as above-mentioned. In this situation, as the coins build up at the first coin return to second rotating disk 20, then the coin runs into next coin 14 or into projection 30. Therefore, the "clink" is larger. Also, the passed coins 14 of gate unit 34 are guided by curved guiding section 48 and straight section 50 which extends perpendicular, and are dispensed by dispensing unit 52 at the top.

Japanese Examed Utility Model number 4-45090 discloses a holding unit which includes a ball and a slanting surface that is attached. The ball falls by gravity, and is moved towards the side plate by the slanting surface. The coin is held by the ball. If the coin passageway slants, the ball cannot be held quickly. Therefore, the time to hold of the coin takes longer. In other words, Japanese Examed Utility Model number 4-45090 is valid in a perpendicular use. The perpendicular is from 80 degrees to 110 degrees.

In Japanese Examed Utility Model number 4-45090 the disclosed coin dispensing device has a rotating disk for dispensing the coins slants, for example the rotating disk slants at 60 degrees for dispensing stability. Therefore the first coin which is moved by the rotating disk slants at 60 degrees. When Japanese Examed Utility Model number 4-45090 is located at the first coin in FIG. 7, the first coin isn't caught quickly. As a result, the "clink" will occur.

SUMMARY OF THE INVENTION

One aspect of this present invention is to prevent the returning of the first coin, and prevent the result of the clink noise.

To solve this problem, this present invention provides a coin dispensing device in which coins are dispensed to a guiding unit by a rotating disk one by one. The dispensed coins are guided upwards by said guiding unit in a line. The device includes a preventing unit to prevent the first coin going backward. The preventing unit is located adjacent to a rotating disk. The first coin which was dispensed by said rotating disk is prevented from moving backwards.

In this structure, the coins are dispensed to the guiding unit one by one by the rotating disk. In the guiding unit, the coins are aligned, and have rim to rim contact. The coin in the front position is moved by the coin in the rear, and is guided upwards, afterwards the coin is dispensed. Then the first coin which is dispensed by the rotating disk is held by the preventing unit, and is prevented from returning to the rotating disk. In other words, the coin which is dispensed by the rotating disk can not go in reverse. Accordingly, the coin does not run into the next coin or the rotating disk. Therefore the "clink" does not occur.

The preventing unit that prevents the first coin from going backwards may be a roller. With this structure, when the coins move to reverse, the first coin is stopped by the preventing unit which has contact with the first coin, because the roller cannot rotate. On the one hand, when the first coin passes the peripheral surface of the roller, the first coin can pass by applying a small force. Accordingly, the resistance of the rotating disk is slightly increased. Therefore the reverse movement of the first coin is prevented from the "clink" effect.

The roller structure may include a backstop unit which only rotates in one direction. With this structure, the first coin goes or is urged toward the dispensing direction. In this structure, the roller cannot rotate in a rotating direction which is the reverse direction, due to the backstop. Accordingly, the roller can not rotate in the reverse direction of the coins.

The roller may be guided by a guiding section in, wherein the roller approaches to a guiding surface and the rotating disk. In this structure, the roller is guided by the slanting elongate hole, wherein the roller approaches the guiding surface and the rotating disk. In other words, when the coin moves to the reverse direction, the roller moves near to the rotating disk, because the roller is drawn by the coin. The roller which is guided by the slanting elongate hole moves near the guiding surface. Accordingly, the pushing force which pushes the coin to the guiding surface increases. Therefore the holding force between the roller and the guiding surface increases, and the coin is held. The reverse movement of the coin is prevented, and the clink is prevented.

The roller may be urged towards said rotating disk. In this structure, the roller is always urged towards the rotating disk. The roller is always urged towards the guiding surface by the slanting elongate hole, and pushes positively to the first coin to the guiding surface. Accordingly, the coin cannot be moved into the reverse position by the roller. As a result, the "clink" does not occur.

According to another aspect of the invention, a coin dispensing device is provided in which coins are dispensed to a guiding unit by a rotating disk one by one. The dispensed coins are guided upwards by the guiding unit in a line. The device includes a roller which is located adjacent to the rotating disk and has contact with the first coin which is dispensed by the rotating disk. The roller is attached to a shaft through a one-way clutch which allows the coin to go to the moving direction and does not allow it to go in the opposite direction. The shaft is guided by a slanting elongate hole which approaches the guiding surface and the rotating disk and is urged towards said rotating disk.

With this structure, the last coin which is dispensed by the rotating disk is pushed to the guiding surface by the roller. Also, the roller is supported on the shaft through a one-way-clutch. The one way clutch can rotate in the moving direction of the coin and cannot rotate in the opposite direction. Accordingly, when the coins are reversed, the roller is in a static situation. Also, the shaft can slide into the slanting elongate hole and is urged towards the rotating disk. When the roller moves towards the rotating disk, the shaft is guided by the slanting elongate hole and moves towards the guiding surface. Therefore the holding force which is between the roller and the rotating disk increases, and the first coin cannot to in the reverse. As a result, the "clink" effect does not occur.

A coin dispensing device provides a dispensing of the coins to a guiding unit by a rotating disk one by one. The dispensed coins are guided upwards by the guiding unit in a line. The roller is located adjacent to the rotating disk and has contact with the first coin which is dispensed by said rotating disk. The roller is attached to a shaft through a one-way clutch which allows the coin to go to the moving direction and does not allow it in the opposite direction. The shaft is guided by a slanting elongate hole which approaches the guiding surface and the rotating disk and is urged towards the rotating disk.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
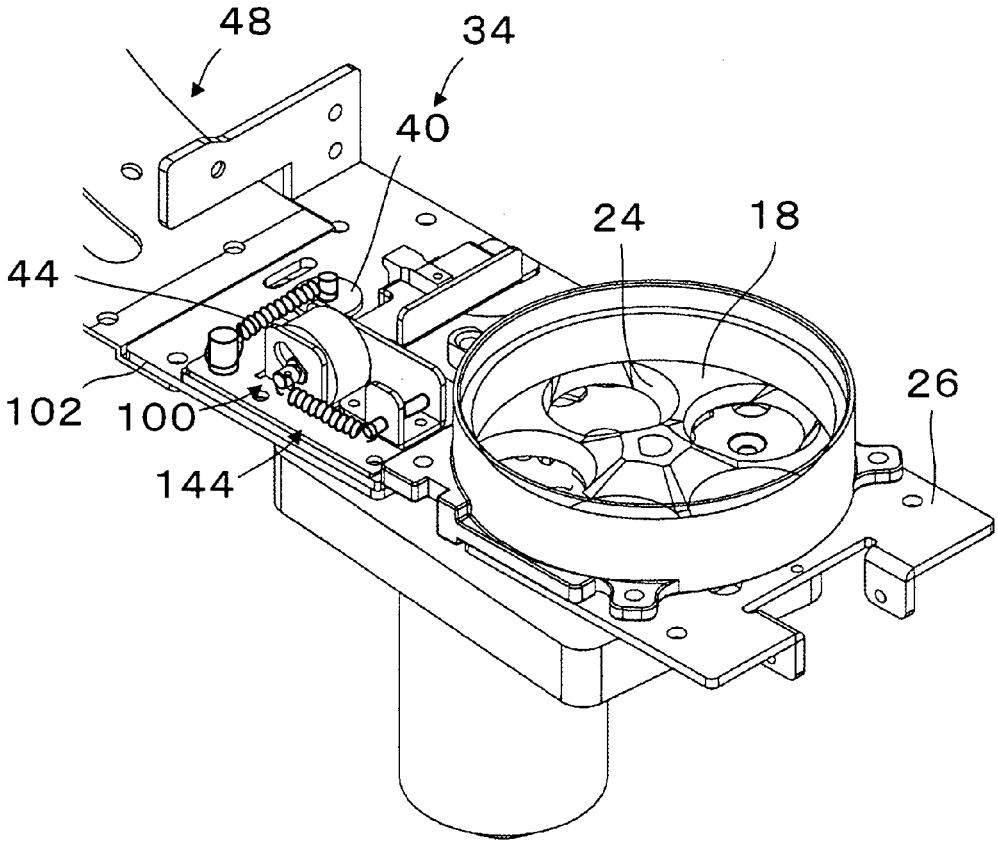
FIG. 1 is a perspective view of the coin dispensing device with a preventing unit of a preferred embodiment according to the invention.
Figure 4A:
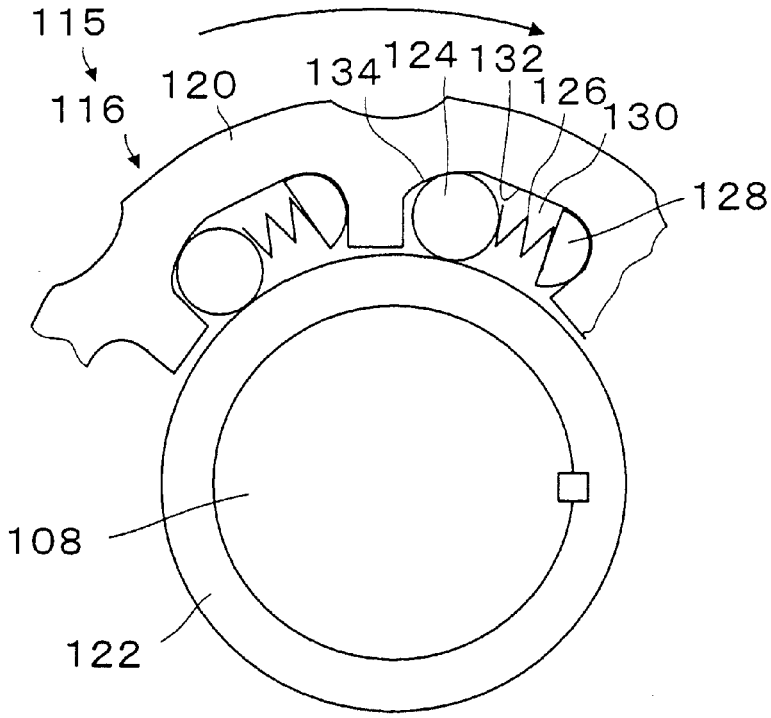
FIG. 4A is a view for explaining the one-way clutch of the preferred embodiment according to the invention.
Figure 4B:
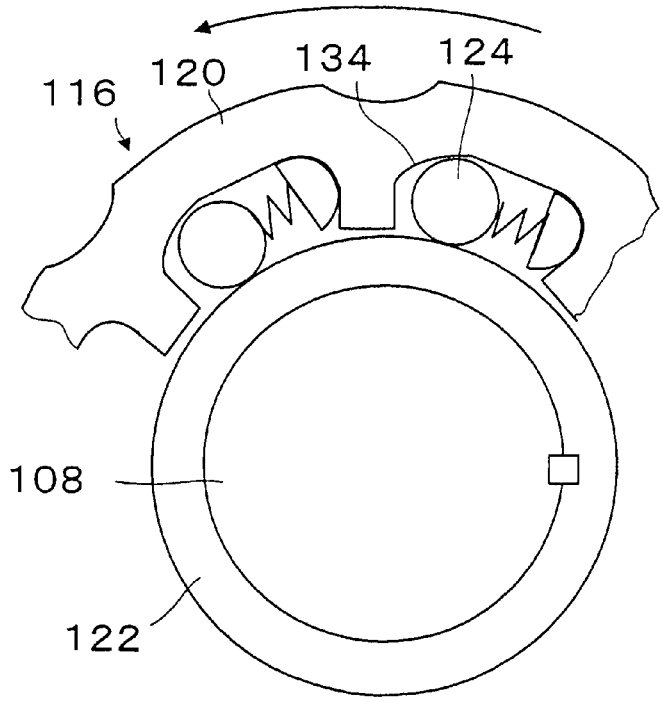
FIG. 4B is another view for explaining the one-way clutch of the preferred embodiment according to the invention.
Figure 5:
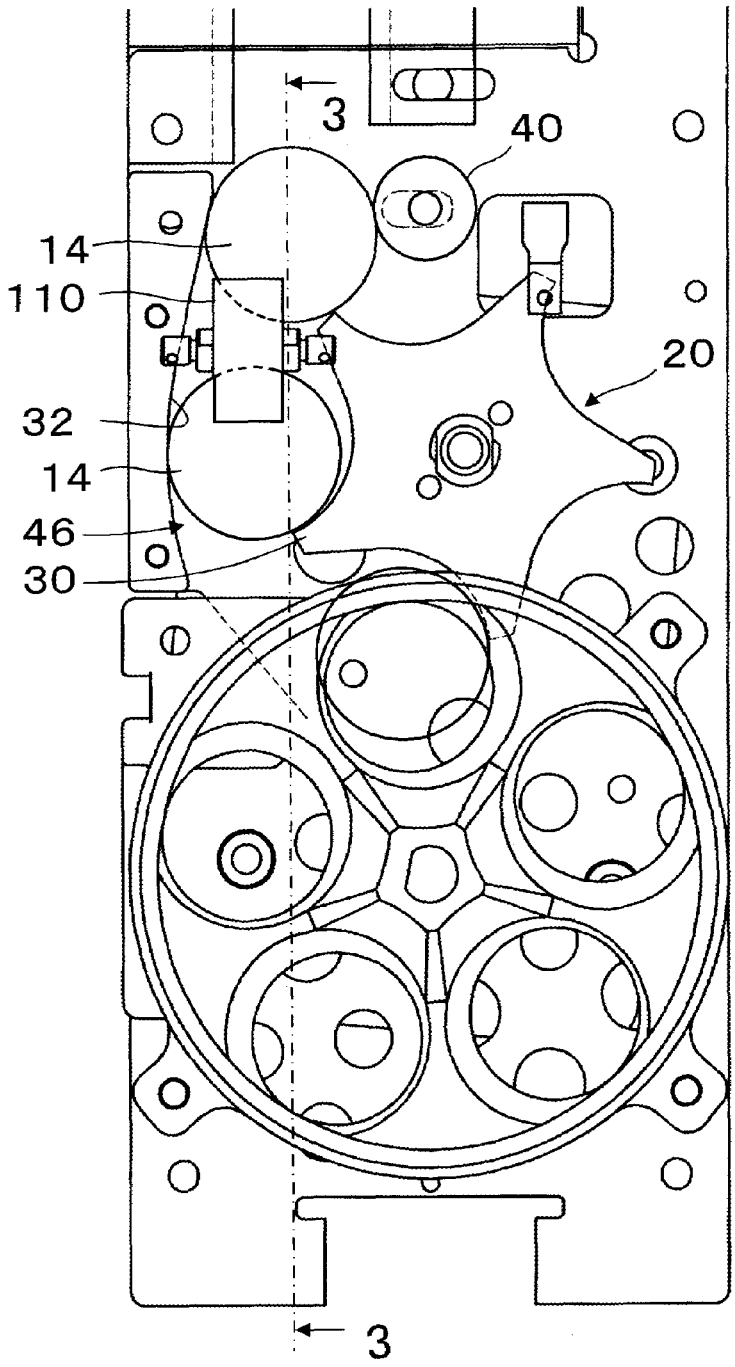
FIG. 5 is a view for explaining the operation of the preferred embodiment according to the invention.
Figure 6:
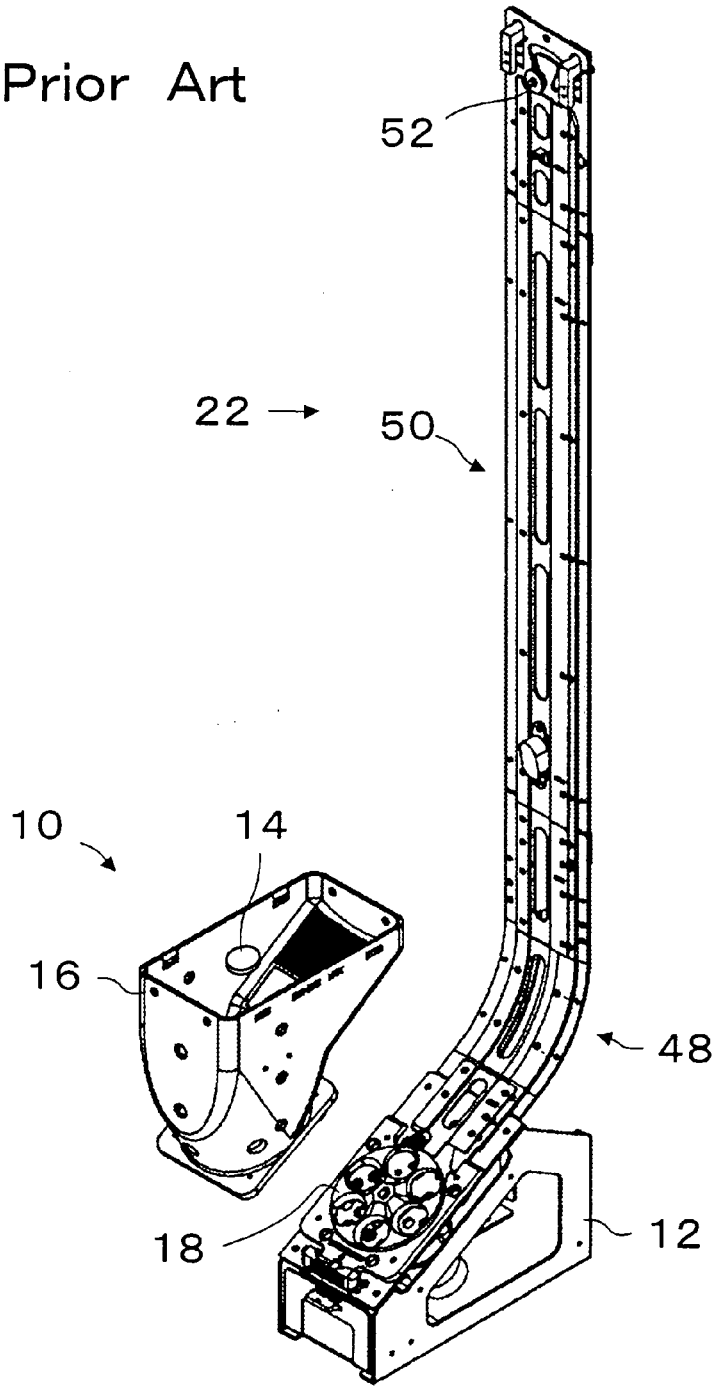
Fig. 6 Prior Art
FIG. 6 is an exploded view of a known device.
Figure 7:
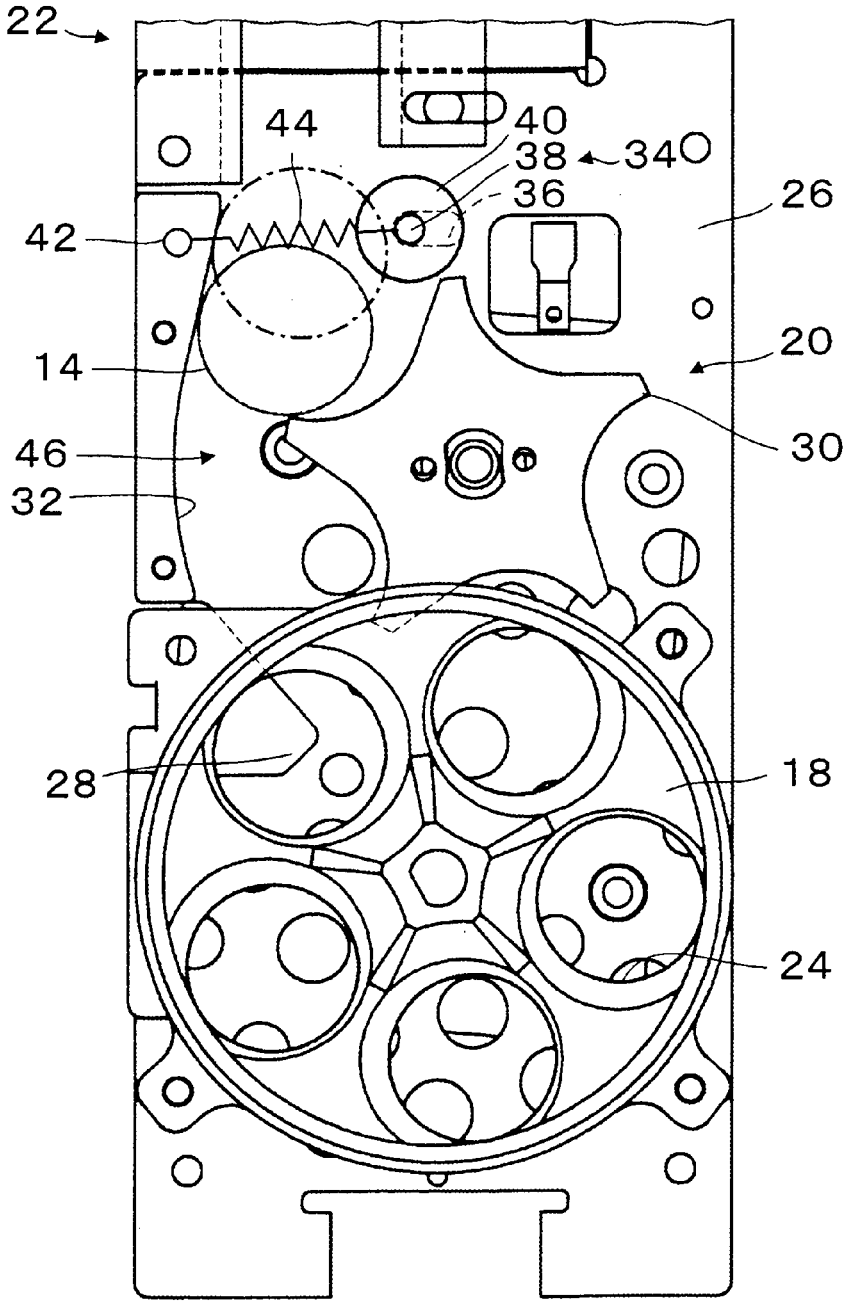
Fig. 7 Prior Art
FIG. 7 is a plan view of a prior art device.

Referring to the drawings and in particular to FIGS. 1 to 5, the parts are designated by numbers that are the same as in FIGS. 6 and 7, and the different and additional structures are explained using additional reference numbers. In FIG. 1, a preventing unit 100 is provided to return a first coin. The preventing unit 100 is fixed on a guiding plate 102 which defines the upper section of a coin passageway 46. The preventing unit 100 has a function in which when a first coin 14 is dispensed from the second rotating disk 20, the coin cannot return to the side of the second rotating disk 20.

Figure 2:
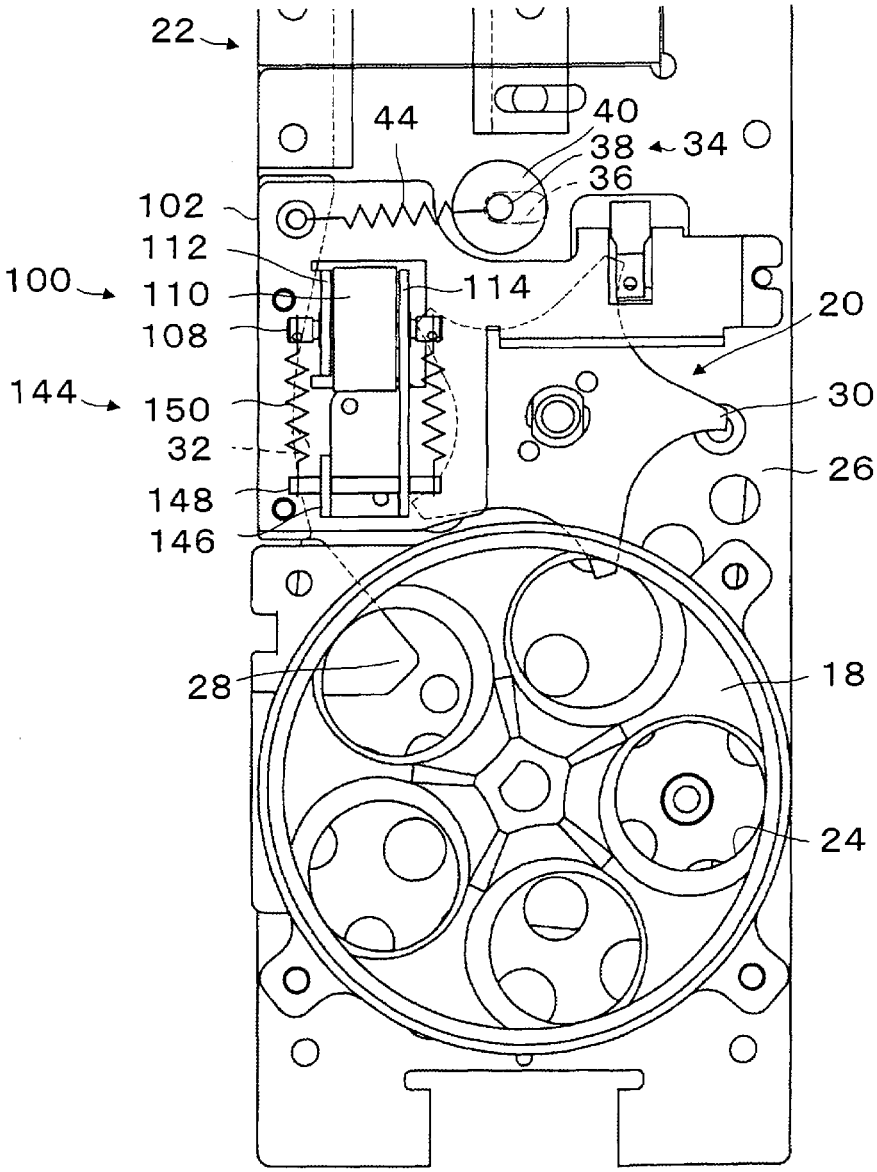
FIG. 2 is a plane view of the coin dispensing device with the preventing unit of the preferred embodiment according to the invention.
Figure 3:
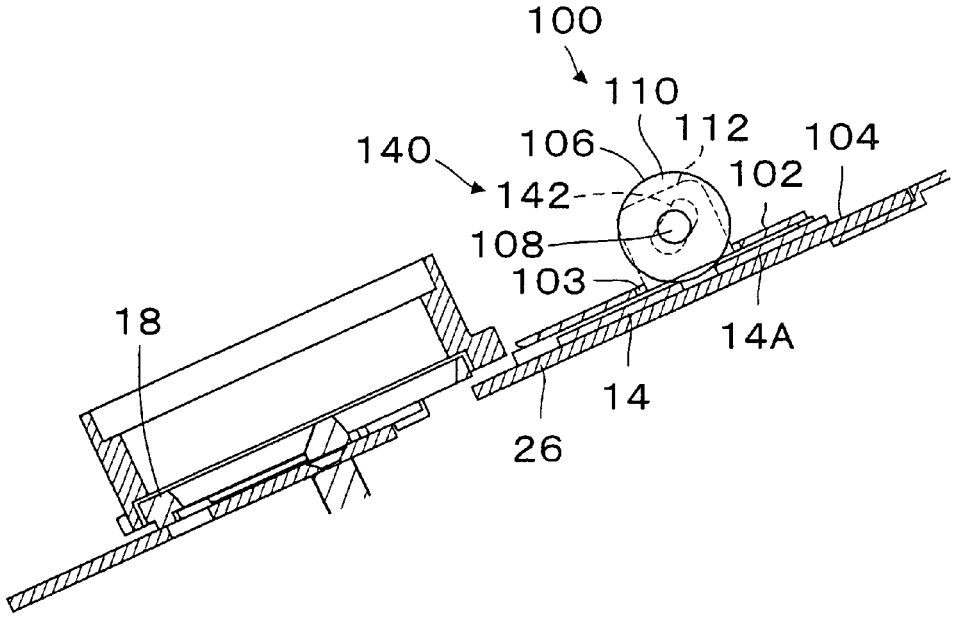
FIG. 3 is a cross sectional view taken at line 3–3 in FIG. 5.

The preventing unit 100 includes a roller 110 which can rotate on shaft 108. The roller 110 is located near a guide surface 104 of a base 26. The distance between a peripheral surface 106 of the roller 110 and the guiding surface 104 is smaller than the thickness of coin 14 or is zero. In other words, the peripheral surface 106 and guiding surface 104 are in contact. The lower section of roller 110 passes through an opening 103 of the guiding plate 102 and is located at the coin passageway 46 and beside second rotating disk 20. As shown in FIG. 2, both ends of the shaft 108 are supported by bearing plates 112, 114 which are fixed at the guiding plate 102. The shaft 108 is fixed at bearing plates 112, 114, however it is desirable to change the distance between the guiding surface 104 to as discussed below.

The roller 110 may advantageously be made from an urethane rubber or EPDM etc., because the holding force becomes larger. The roller 110 can be operated at a large friction rate, for example, it can be made from another material and the peripheral surface is processed to a satin finished surface. When the distance between peripheral 106 of roller 110 and guiding surface 104 is smaller than the thickness of coin 14, the return of coin 14 is prevented. When the coin returns in an opposite direction to the moving direction, the coin 14 must go into the space between the peripheral surface 106 of roller 110 and guiding surface 104 or coin 14 is pushed to guiding surface 104. Therefore, the movement of coin 14 is stopped. In other words, the coin 14 is not acted on by gravity to make it go into the space between peripheral surface 106 and the guiding surface 104 or the force is smaller than the holding force between peripheral surface 106 and the guiding surface 104.

However, for the roller 110, it is desirable for preventing the return of the coin to make the roller 110 as follows. The roller 110 is attached to shaft 108 through backstop unit 115. This is for example a one-way clutch 116 which can rotate in the moving direction of coin 14 and can't rotate in the opposite direction. In this structure, when the coin 14 goes into the space between the roller 10 and guiding surface 104, the roller 110 can not reverse. In this structure, when coin 14 falls down between peripheral surface 106 and guiding surface 104, the roller 110 can not reverse its direction. Therefore the coin 14 cannot return.

For example, the one-way clutch 116 includes an outer-race 120, an inner-race 122, a ball 124 as a lock, a spring 126 which is an urging means for the ball 124 and a retainer 128 as shown in FIGS. 4A and 4B. The inner-race 122 is attached to the shaft 108 and cannot rotate. Also the shaft 108 is attached to the bearing plates 112,114 and is not rotatable. For example, a pair of parallel plane sections are located at shaft 108. The parallel plane sections are inserted into slanting elongate hole 142 and are slideable.

A holding groove 130 is U-shaped and is located at the inner-surface of outer-race 120 which is ring-shaped and is located outside. Holding groove 130 includes an opening wall 132 and a locking wall 134. The opening wall 132 is spaced away from the peripheral surface of the inner-race 122 by the diameter of ball 124. A locking wall 134 has a slant like approach to the inner-race continuing to the opening wall 132.

The ball 124 is located in the holding groove 130. The spring 126 is located between the retainer 128 and the ball 124. The ball 124 is urged to lock wall 134 by spring 126. The roller 110 is cylinder-shaped and is fitted to outer-race 120. The roller 110 is rotated in the counter clockwise direction by coin 14 which is moved by projection 30 of the second rotating disk 20 through one-way clutch 116 as shown in FIG. 4B.

As shown in FIG. 4B, the outer-race 120 of the one-way clutch 116 is rotated in the same direction. Accordingly, the ball 124 is away from the lock wall 134, the inward bias of the ball 124 is released. In other words, the ball 124 and outer-race 120 are not unified. Therefore, the roller 110 is rotated together with the movement of the coin 14. The coin 14 passes through the space between peripheral 106 and guiding surface 104 and does not receive large resistance.

When the coin 14 returns, the roller 110 is rotated in the clockwise direction as shown in FIG. 4A. The outer-race 120 of the one-way clutch 116 is rotated in the clockwise direction as shown in FIG. 4A. Accordingly, ball 124 which is in contact with the lock wall 134 by spring 126 is rotated in the same as direction. Also, the ball 124 goes into the space between the lock wall 134 and the outer-race 120. Therefore, the outer-race 120 and the inner-race 122 are rotated.

However, the roller 110 does not rotate, because inner-race 122 is not rotatable on the shaft 108 and the shaft 108 is not rotatable on the bearing plates 112, 114. Therefore, the coin 14 can not go into the space between roller 110 and guiding surface 104 or the coin 14 can not fall down the space between roller 110 and guiding surface 104, because roller 110 does not rotate.

Therefore, the shaft 108 and the roller 110 are guided towards guiding surface 104 by a guiding section 140 with mutual approach being desirable, because the returning of coin 14 is further prevented. The guiding section 140 is provided by slanting elongate holes 142 which are located at the bearing plates 112, 114. These slanting elongate holes 142 slant in the direction approaching the second rotating disk 20 and guiding surface 104.

Therefore, when coin 14 reverses its direction, the roller 110 is pushed by coin 14. The shaft 108 approaches the guiding surface 104 due to the slanting elongate holes 142. Accordingly, the distance between peripheral surface 106 of the roller 110 and the guiding surface 104 is reduced, the coin 14 can not go into the space between the peripheral surface 106 and the guiding surface 104 or the coin 14 can not fall down the space between the peripheral surface 106 and the guiding surface 104. Also, the degree of slant of the slanting elongate hole 142 is preferably small such that the coin 14 moves smoothly. The slant angle which is from 30 to 45 degrees, and is approximately 35 degrees to guiding surface 104 in the preferred embodiment to maintain a small or miniature size.

Also, when a guiding section 140 is provided, it is desirable to set an urging unit 144 for preventing the return of coin 14. The distance between the roller 110 and the guiding surface 104 is always maintained at its smallest by urging unit 144. When coin 14 returns, the distance between the roller 110 and the guiding surface 104 is zero or very narrow. Therefore, coin 14 can not go into the space or coin 14 can not fall down from the space. The urging unit 144 includes springs 150 which are hooked between the both ends of pin 148 which is fixed at the bearing plate 114 and the bracket 146 between both of the ends of the shaft 108 as shown in FIGS. 1 and 2.

In this structure, the shaft 108 is urged towards the second rotating disk 20 by the spring 150, and is urged towards guiding surface 104 by slanting elongate hole 142. Accordingly, the roller 110 is in contact with the guiding surface 104. When there is a stopper (not shown) for the shaft 108, the space is smallest. Therefore when the coin 14 returns, the coin 14 can not go into the space or the coin 14 can not fall down.

Next, the operation of the preferred embodiment is explained referring to FIG. 5. The coin 14, which is moved by projection 30 in a clockwise direction of the second rotating disk 20, is guided by guiding surface 32 and is moved in coin passageway 46. In this process, the coin 14 pushes the roller 110 up in a direction opposite the force of the spring 150.

In this process, the shaft 108 is moved away from the guiding surface 104, and the distance between the shaft 108 and the guiding surface 104 is increased. Also, the roller 110 can rotate in the counter clockwise direction by the one-way clutch 116 as shown in FIG. 4. Therefore, the moving resistance to the coin 14 is smaller, and the coin 14 is moved by the second rotating disk 20. The coin 14 which passes through the space between roller 110 and peripheral 106 is pushed up to the solid line shown in FIGS. 5 and 3 by projection 30. The roller 40 is slightly moved by the coin 14.

Afterwards, the projection 30 is away from the lower section of the coin 14. In this process, the coin 14 slides to the side of the second rotating disk 20 on the guiding surface 104 by gravity and the other coin's weight. However the coin 14 is stopped as above-mentioned. Therefore, the first coin 14 which is dispensed by the second rotating disk 20 is held by roller 110. Next, the dispensed coin 14 pushes the first coin 14. The first coin 14 passes through gate unit 34 and is moved to curved guiding unit 48. Therefore, coin 14 which is dispensed by the second rotating disk 20 doesn't run into the second rotating disk 20, and doesn't "clink".

Also, the roller 110 can be changed to only a roller. However, the roller 110 can be combined with at least the backstop unit 115 or the guiding section 140. Also, the guiding section 140 cannot be combined with the urging unit 144 (the guiding section 140 does not require the urging unit 144). The urging unit 144 can be changed to a weight, a magnet (include an electromagnet), etc. Also, this invention can be applied to a dispensing device without the second rotating disk 20. The gate unit 34 can be removed.

While specific embodiments of the invention have been shown and described in detail to illustrate the application of the principles of the invention, it will be understood that the invention may be embodied otherwise without departing from such principles.

What is claimed is:

1. A coin dispensing device comprising:

a first rotating disk for dispensing coins one by one to a guiding unit, said guiding unit guiding the dispensed coins to a coin dispensing outlet; and a return preventing unit located downstream from said rotating disk, said return preventing unit holding a coin before said coin moves in a dispensing direction towards said coin dispensing outlet and preventing said coin from moving in a reverse direction back towards said rotating disk, said preventing unit comprising a roller downstream from said rotating disk, said roller being supported by a shaft, said shaft being placed in a shaft support, said shaft support having a slanting elongate hole, said slanting elongate hole guiding said shaft towards said rotating disk.

2. The coin dispensing device in accordance with claim 1, wherein said roller having a backstop unit, said backstop unit only rotating in a dispensing direction, wherein a first coin only moves in said dispensing direction.

3. The coin dispensing device in accordance with claim 1, wherein said roller is guided by a guiding section having a guiding surface, wherein said roller is disposed adjacent to said guiding surface and said rotating disk.

4. The coin dispensing device in accordance with claim 1, further comprising a second rotating disc adjacent to said first rotating disc, wherein a projection of said second rotating disc contacts said coin, moving said coin from said first rotating disc towards said coin dispensing outlet.

5. A coin dispensing device comprising:

a rotating disk for dispensing coins to a guiding unit one by one, the dispensed coins being guided upwards by said guiding unit in a line;

a roller located adjacent to said rotating disk for contacting a first coin which is dispensed by said rotating disk;

a shaft;

a one way clutch, said roller being attached to said shaft through said one-way clutch which allows the coin to go to a moving direction and does not allow the coin in an opposite direction; and a shaft support with a slanting elongate hole, said shaft being guided by said slanting elongate hole which approaches said guiding surface and said rotating disk and said shaft is urged towards said rotating disk.

6. The coin dispensing device in accordance with claim 5, wherein said slanting elongate hole having a slant angle of thirty to forty-five degrees with respect to said guiding surface.

7. A coin dispensing and guiding system, comprising:

a guiding unit for guiding coins upwards in a dispensing direction to a coin passageway outlet;

a rotating disk located upstream from said guiding unit, said rotating disk dispensing coins one by one to said guiding unit; and a coin preventing means for holding said coin to dampen coin vibration and preventing said coin from moving in a rearward upstream direction towards said rotating disk, said coin preventing means being located downstream from said rotating disk, said coin preventing means comprising a roller adjacent to said rotating disk, said roller being supported by a shaft, said shaft being placed in a shaft support, said shaft support having a slanting elongate hole, said slanting elongate hole guiding said shaft towards said rotating disk.

8. The system in accordance with claim 7, wherein said roller having a backstop unit allowing said roller to only rotate in a dispensing direction, wherein a first coin only moves in said dispensing direction.

9. The system in accordance with claim 7, further comprising a roller guide section, said roller being guided by said roller guide section, said guide section having a guiding surface, wherein said roller is disposed adjacent to said guiding surface and said rotating disk.

* * * * *